US007044798B2

(12) United States Patent
Takei et al.

(10) Patent No.: US 7,044,798 B2
(45) Date of Patent: May 16, 2006

(54) CARD CONNECTOR

(75) Inventors: Kazunori Takei, Tokyo (JP); Hirokazu Takahashi, Tokyo (JP)

(73) Assignee: DDK Ltd., (JP)

( * ) Notice: Subject to any disclaimer, the term of this patent is extended or adjusted under 35 U.S.C. 154(b) by 0 days.

(21) Appl. No.: 10/911,103

(22) Filed: Aug. 4, 2004

(65) Prior Publication Data

US 2005/0136743 A1 Jun. 23, 2005

(30) Foreign Application Priority Data

Dec. 17, 2003 (JP) ..... 2003-419577

(51) Int. Cl.
*H01R 24/00* (2006.01)

(52) U.S. Cl. ..... 439/630

(58) Field of Classification Search ..... 439/630, 439/862, 637; 235/441
See application file for complete search history.

(56) References Cited

U.S. PATENT DOCUMENTS 4,491,382 A * 1/1985 Ishikawa ..... 439/839
4,975,086 A * 12/1990 Reichardt et al. ..... 439/629
5,453,028 A * 9/1995 Grambley et al. ..... 439/441
5,775,950 A * 7/1998 Tsuji ..... 439/637
6,106,337 A * 8/2000 Yu et al. ..... 439/637
6,409,546 B1 * 6/2002 Ito et al. ..... 439/630
6,945,800 B1 * 9/2005 Weight et al. ..... 439/136
2001/0006855 A1 * 7/2001 Koitsalu ..... 439/188

* cited by examiner

*Primary Examiner*—Neil Abrams
(74) *Attorney, Agent, or Firm*—Baker Botts L.L.P.

(57) ABSTRACT

A card connector for use with an electronic appliance through an IC card having a plurality of recesses extending from its front end toward its rear end in parallel with one another and contact pads each being received in the recess. The card connector includes a connector housing and contact terminals. The connector housing has a pair of guide grooves for supporting and guiding both side edges of a card being inserted into the card connector and an insertion space in the housing for the inserted card. The contact terminals made of a springy and electrically conductive material are arranged in the connector housing and each have a contact portion adapted to contact with a contact pad of the card normally inserted in the card connector. According to the invention, the card connector comprises support protrusions each provided at a location below at least the contact portion of the contact terminal to limit the downward displacement of the contact portion of the contact terminal when the card has been normally inserted in the card connector, thereby ensuring a contact force more than a predetermined value between the contact portions of the contact terminals and the contact pads of the card.

4 Claims, 9 Drawing Sheets

CARD CONNECTOR

BACKGROUND OF THE INVENTION

This invention relates to a card connector for use with various kinds of electronic appliances such as, for example, a mobile phone or cellular telephone, a digital camera and the like.

The electronic appliances such as mobile phone and digital camera are usually constructed to enable the loading of an IC card (integrated circuit card) in which CPU or IC for memory is built, such as multimedia card®, for the purpose of extensions of various functions.

Widely used as means for detachably loading such an IC card onto the electronic appliances are card connectors in which a plurality of contact terminals 102 are provided in a connector housing 101 as shown in FIGS. 7*a* and 7*b*. These contact terminals 102 are adapted to be connected to various electric circuits (not shown) on the side of an electronic appliance. As shown in FIG. 8, when a card 103 is inserted in the card connector, contact portions 108 of the contact terminals 102 each become in electrically contact with a contact pad 106 received in each of recesses 105 formed in the front end 104 of the IC card 103, thereby electrically connecting the contact pads 106 of the IC card 103 and the contact terminals 102 of the card connector 100. The card connector 100 and the IC card 103 thus in the connected relation are connected to an electronic appliance, thereby enabling the exchange of electric signals or information between the IC card 103 and the electronic appliance.

Usually, contact terminals 102 of a card connector 100 are made of an electrically conductive material having a springiness by means of which a contact force can be obtained between the contact pads 106 of the IC card 103 and the contact terminals 102 of the card connector 100 when the IC card 103 has been normally inserted into the card connector 100.

With the contact force utilizing the springiness of the contact terminals 102, however, when numerous insertions and removals of cards into and from the card connector have been effected, the springiness of the contact terminals 102 would be deteriorated due to fatigue and the like so that sometimes no sufficient contact force therebetween would be obtained, resulting in electrically failed connection.

In addition, if an IC card 103 is wrongly inserted with its rear end 107 into the card connector 100 as shown in FIG. 9, the contact portion 108 of each of the contact terminals 102 would be urged downwardly in excess of the elastic deformation, with the result of plastic deformation of the contact terminals 102. Thereafter, even if an IC card 103 is correctly inserted into the card connector 100, it is more difficult to obtain a sufficient contact force between the contact terminals and the contact pads of the card.

Consequently, there is a need for obtaining suitable contact force between the contact pads 106 of the IC card 103 and the contact terminals 102 of the card connector 100 even after IC cards have been normally repeatedly loaded into the card connector. However, we could not find any means for achieving the suitable contact force in known literatures.

SUMMARY OF THE INVENTION

It is an object of the invention to provide an improved card connector capable of maintaining a proper contact force in a stable condition between contact portions of contact terminals and contact pads of card even after cards have been normally repeatedly loaded into the card connector.

In order to achieve the object of the invention, in a card connector for a card having a plurality of recesses extending in parallel with one another from its front end toward its rear end and contact pads each being received in the recess, the card connector comprising a connector housing having a pair of guide grooves for supporting and guiding both side edges of the card being inserted into the card connector and an insertion space for the inserted card; and contact terminals made of a springy and electrically conductive material arranged in the connector housing and each having a contact portion brought into contact with the contact pad of the card normally inserted in the card connector; according to the invention the card connector comprises support protrusions each provided at a location below at least the contact portion of the contact terminal for limiting the downward displacement of the contact portion of the contact terminal.

Preferably, the support protrusions each have a height for contacting and supporting at least part of the contact portion of the contact terminal when the card has been normally or properly inserted into the card connector. In addition, preferably, the support protrusions each further have a height for limiting the downward displacement of the contact portion of the contact terminal when the card is wrongly inserted with its rear end into the card connector.

In a preferred embodiment, the card connector further comprises misconnection preventing stoppers for preventing a wrong insertion of a card, and the misconnection preventing stoppers are each located laterally adjacent the support protrusion and received in the recess of a card when the card has been normally inserted in the card connector. In addition, the misconnection preventing stoppers each have an end face to abut against the rear end of the card at a position slightly short of the contact portion of the contact terminal when the card is wrongly inserted into the card connector.

The support protrusions and the misconnection preventing stoppers may be provided integrally with or independently from one another. More preferably, the contact portions of the contact terminals each have an upwardly projecting curved surface.

According to the invention, the card connector comprises support protrusions each provided at a location below at least the contact portion of the contact terminal, thereby ensuring a proper contact force in a stable condition between contact portions of the contact terminals and contact pads of card even after cards have been normally repeatedly loaded into the card connector.

According to the invention, moreover, the support protrusions each have a height for limiting the excessive downward displacement of the contact portion of the contact terminal so that even if a card is wrongly inserted with its rear end into the card connector, the contact portion of the contact terminal is prevented from being downwardly urged in an excessive extent, thereby preventing the plastic deformation of the contact terminal. As a result, it is possible to obtain a proper contact force more stably between contact portions of the contact terminals and contact pads of the card. In addition, by providing the misconnection preventing stoppers described above, the proper contact force can be ensured with great certainty.

The invention will be more fully understood by referring to the following detailed specification and claims taken in connection with the appended drawings.

DESCRIPTION OF THE PREFERRED EMBODIMENTS

Figure 1:
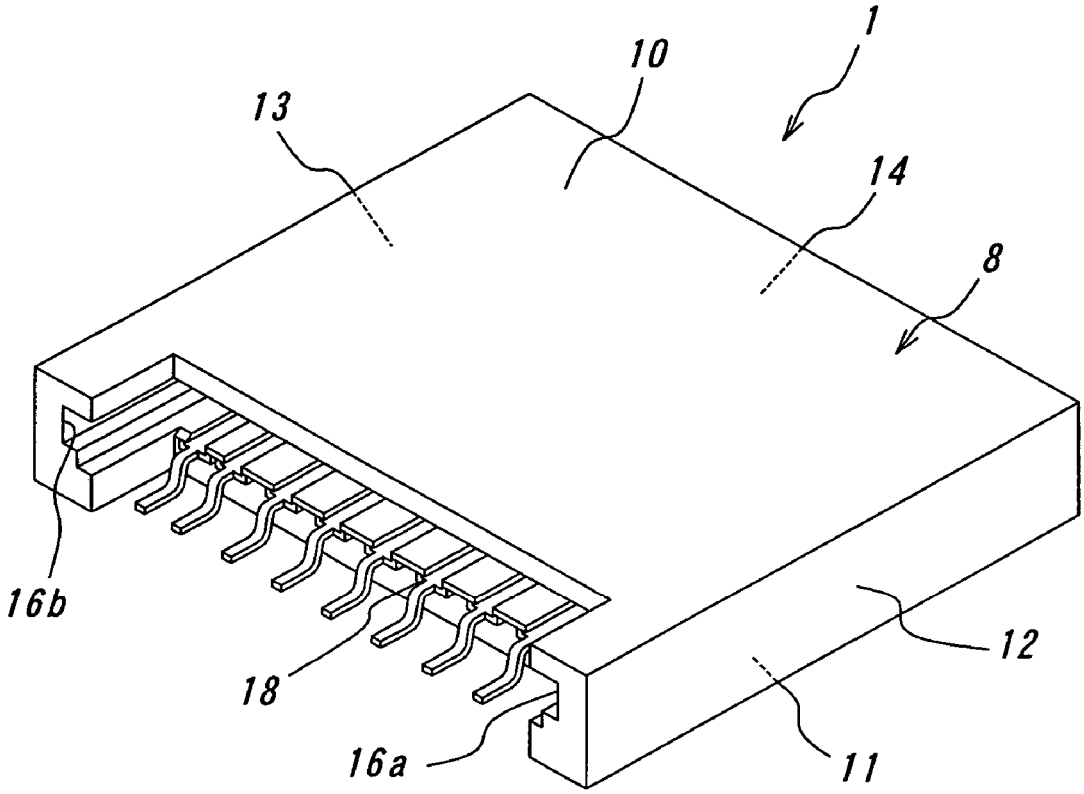
FIG. 1 is a perspective view of the typical card connector according to the invention.
Figure 2A:
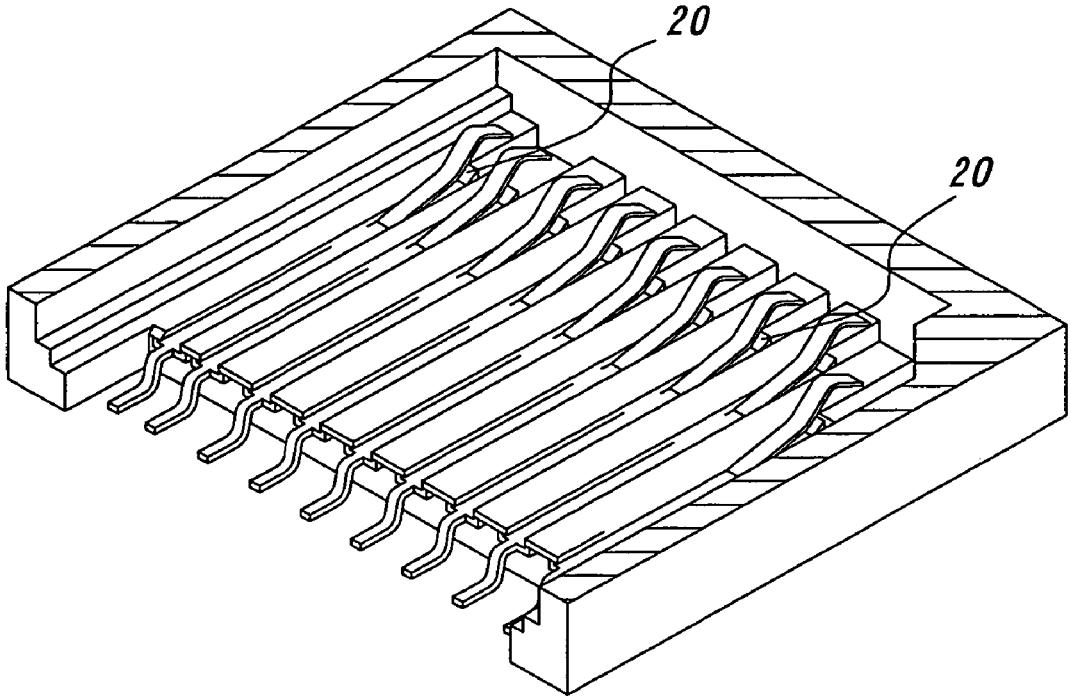
FIGS. 2*a* and 2*b* are a perspective and a sectional view illustrating conditions of contact terminals of the card connector having a connector housing with its upper portions removed prior to loading of a card.
Figure 2B:
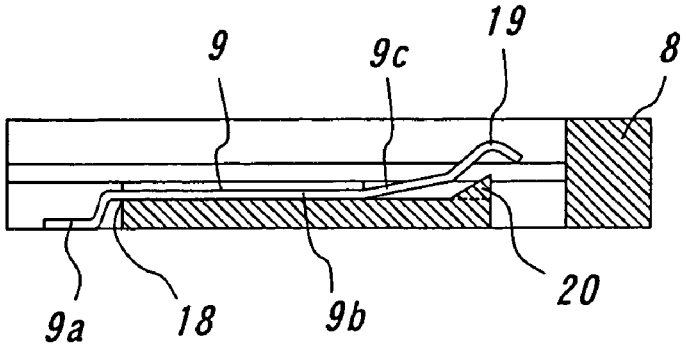
Figure 3A:
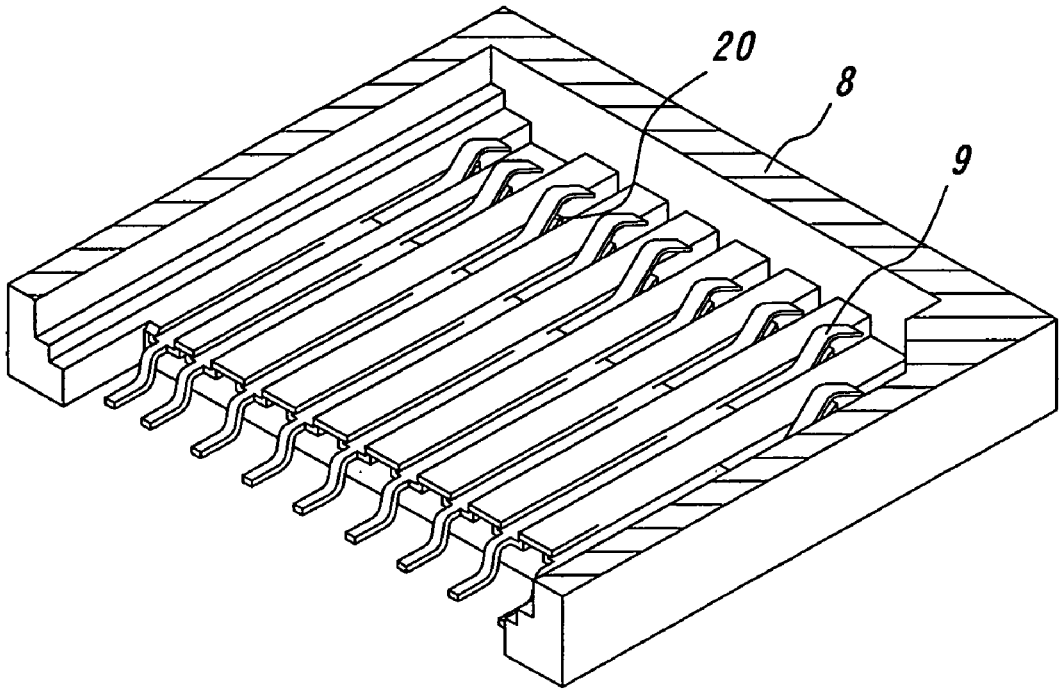
FIGS. 3*a* and 3*b* are a perspective and a sectional view illustrating conditions of contact terminals of the card connector having a connector housing with its upper portions removed after loading of a card.
Figure 3B:
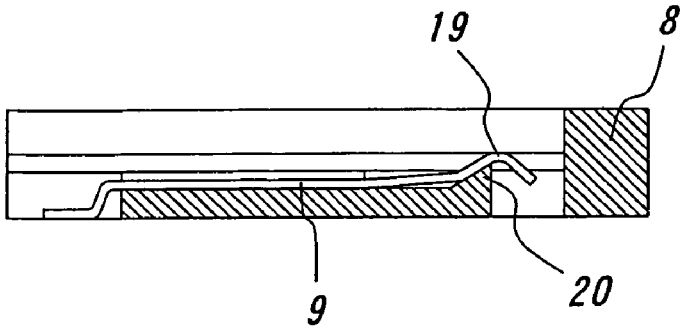
Figure 4A:
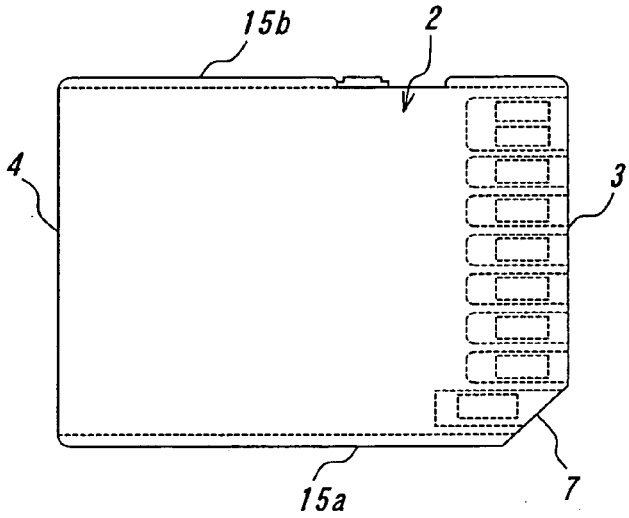
FIGS. 4*a* and 4*b* are a plan and a sectional view of a card before being loaded into the card connector.
Figure 4C:
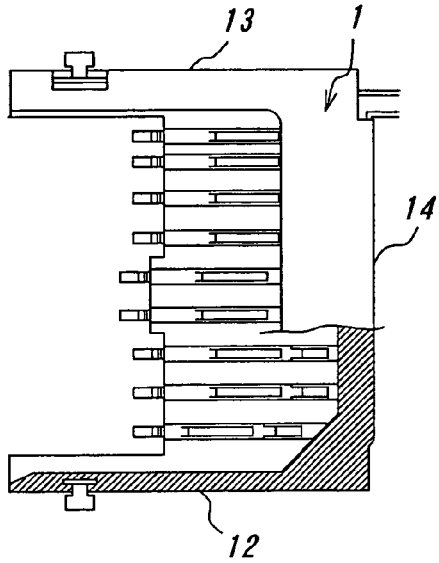
FIGS. 4*c* and 4*d* are a plan and a sectional view of the card connector prior to loading the card.
Figure 4B:
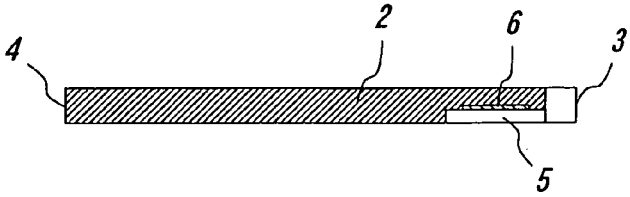
Figure 4D:
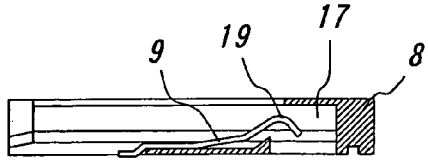
Figure 5A:
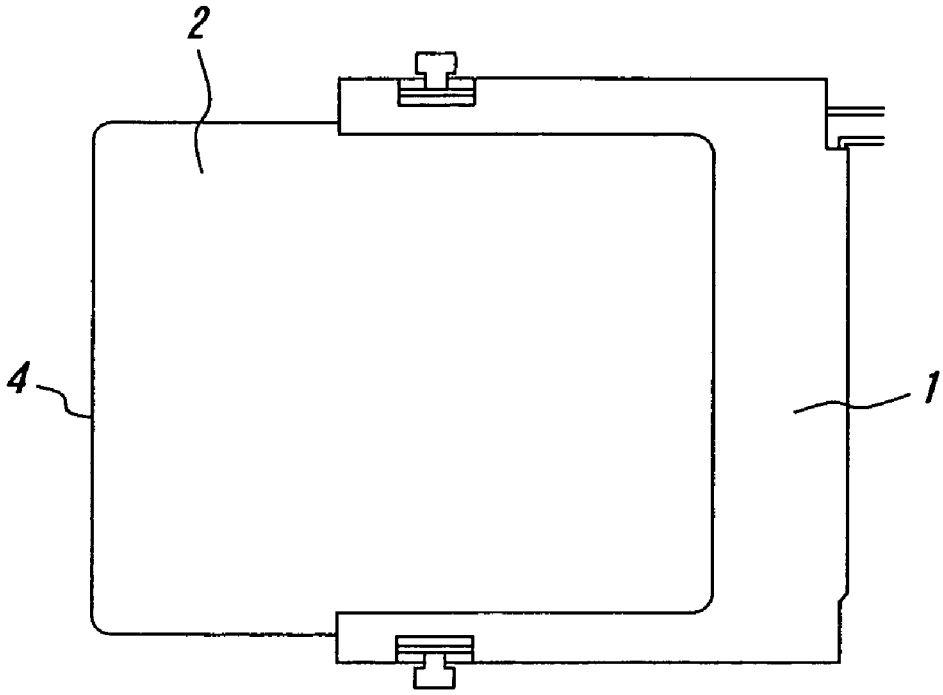
FIGS. 5*a* and 5*b* are a plan and a sectional view of the card connector when the card has been normally loaded therein.
Figure 5B:
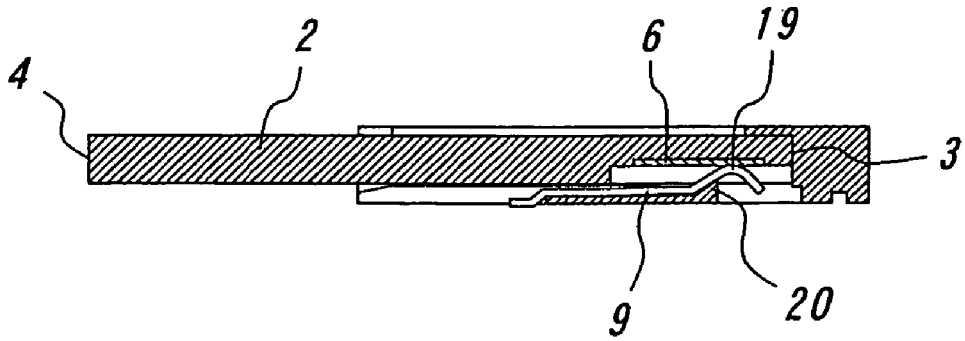

The best mode for carrying out the invention will be explained in detail with reference to the drawings hereinafter. FIG. 1 illustrates in a perspective view a typical card connector according to the invention. FIGS. 2*a* and 2*b* and FIGS. 3*a* and 3*b* show the card connector having a connector housing with its upper portion removed for convenience of explanation. FIGS. 2*a* and 3*a* illustrate in perspective views contact terminals of the card connector before and after a card (not shown) is normally loaded therein, respectively. FIGS. 2*b* and 3*b* also illustrate sections of the card connector taken along the longitudinal center line of a contact terminal under the states of FIGS. 2*a* and 3*a*, respectively. FIGS. 4*a* and 4*b* are a plan and a sectional view of a card, and FIGS. 4*c* and 4*d* are a partly sectional plan and a sectional view of the card connector before the card is loaded thereinto, respectively. FIGS. 5*a* and 5*b* are a plan and a sectional view of a card and the card connector when the card has been normally loaded therein, respectively.

The card connector 1 shown in these drawings is suitable for use with an electronic appliance, for example, a mobile phone or cellular telephone or a digital camera. Cards 2 to be loaded into the card connector 1 include IC cards, such as, for example, a multimedia card®, SD card® (secure digital memory card), memory stick®, SmartMedia®, CompactFlash®, xD picture card® and the like. These IC cards (integrated circuit cards) each have built-in CPU or IC for memory.

Among these cards, for example, the SD card® (secure digital memory card) 2 is formed with a plurality of recesses 5 extending in parallel with one another from the front end 3 toward the rear end 4, each of the recesses having a contact pad 6 received therein. Also, the card 2 is formed with a notch or obliquely cut-off portion 7 at one corner of the front end for precluding the insertion of a card when it is inserted upside down.

The card connector 1 mainly comprises a connector housing 8 and contact terminals 9. The connector housing 8 is made of an insulating material such as a plastic material and mainly consists of an upper plate 10, a lower plate 11 and three side walls 12, 13 and 14 forming a U-shaped wall and connecting the upper and lower plates 10 and 11. The connector housing 8 has a pair of guide grooves 16*a* and 16*b* for supporting and guiding both the side edges 15*a* and 15*b* of the card 2 on being inserted and an insertion space 17 for the card 2. The guide grooves 16*a* and 16*b* are stepped grooves as shown in FIG. 1 capable of receiving a thicker card having stepped edges such as SD card as well as a thinner card having the same shape and size as those of the SD card. The connector housing 8 may be formed by connecting the plates 10 and 11 and the side walls 12 to 14, but preferably, may be molded integrally.

Contact terminals 9 are preferably located in the connector housing 8 by individually inserting them into a plurality of positioning grooves 18 formed in the lower plate 11. The contact terminals 9 are made of a springy and electrically conductive material and have a distal end 9*a* to be connected to a conductive portion of the printed circuit board of an electronic appliance by soldering, a fixed portion 9*b* positioned and fixed in the positioning groove 18 as by press-fitting, and a free end 9*c* extending upwardly toward the side wall 14 and having a contact portion 19 adapted to contact a contact pad of a card when it is normally loaded in the card connector.

Forming a subject feature for constituting the invention are support protrusions 20 provided at locations below at least the contact portions 19 of the contact terminals 9 for limiting the downward displacement of the contact portions 19 of the contact terminals 9. Employing such an arrangement can ensure the proper contact force more than a predetermined value between the contact portions 19 of the contact terminals 9 and the contact pads 6 of the card 2 with great stability even after cards have been normally repeatedly loaded in the card connector 1. The term "contact force more than a predetermined value" is here understood in practice as signifying a contact force within a range more than 0.2N when the contact portion 19 of the contact terminal 9 contacts the contact pad 6 of the card 2.

In order to obtain the contact force stably described above, it is preferable that the support protrusions 20 each have a height for contacting and supporting at least part of the contact portion 19 of the contact terminal 9 when a card is normally loaded in the card connector. For example, the downward displacement of the contact portion 19 of the contact terminal 9 is preferably 0.3 to 0.6 mm when a card is normally loaded in the card connector.

Moreover, it is more preferable that the support protrusions 20 each have a height for limiting the downward displacement of the contact portion 19 of the contact terminal 9 when the card 2 is inserted wrongly with its rear end 4 into the card connector 1 in order to prevent the plastic deformation of the contact portion 19 of the contact terminal 9. Practically, the support protrusions 20 preferably have a height which makes it impossible for the lower surface of the card 2 to pass over the contact portions 19 of the contact terminals 9. For example, with SD cards, the height of the support protrusions 20 may be 1.6 to 2.2 mm.

Figure 6:
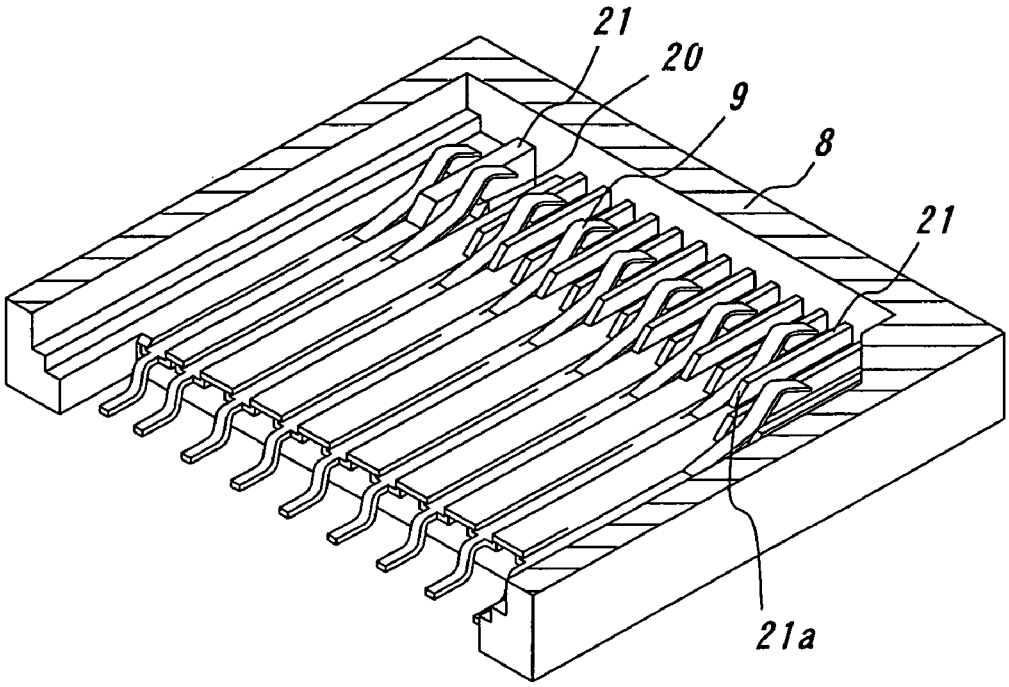
FIG. 6 is a perspective view illustrating a card connector according to another embodiment of the invention.
Figure 7A:
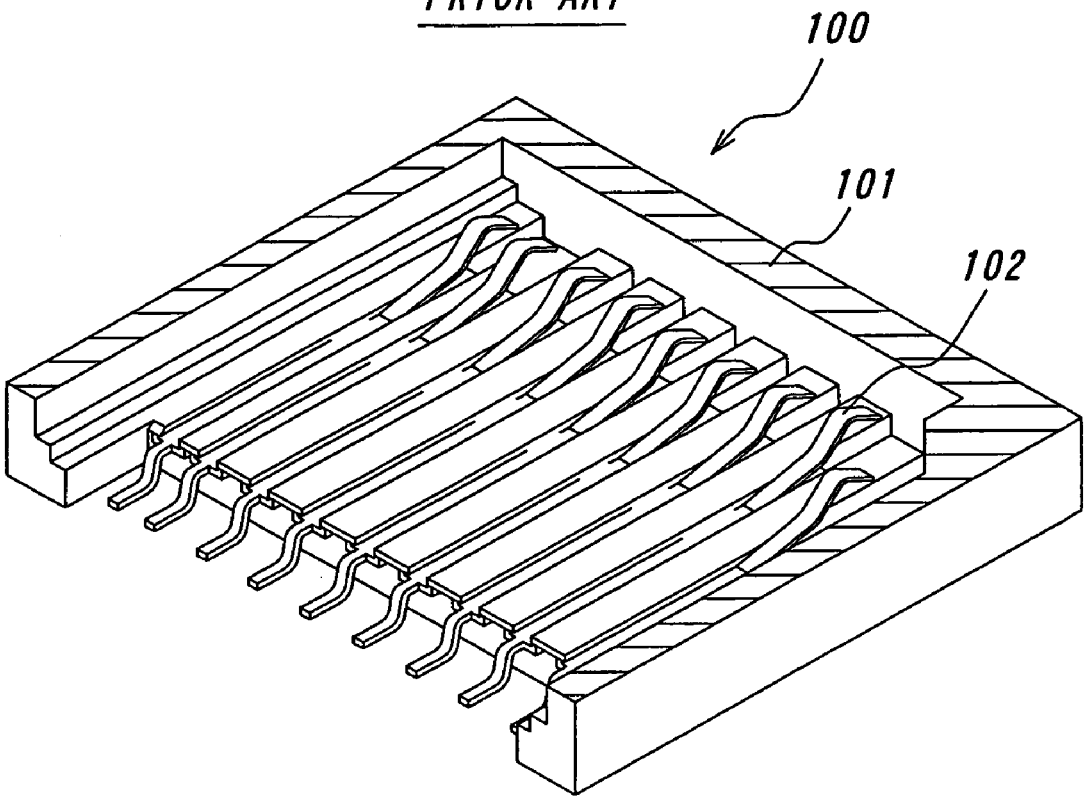
FIG. 7a PRIOR ART
FIGS. 7*a* and 7*b* are a perspective and a sectional view of the card connector of the prior art.
Figure 7B:
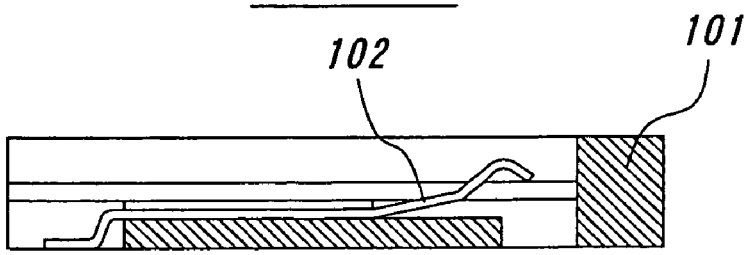
FIG. 7b PRIOR ART
Figure 8:
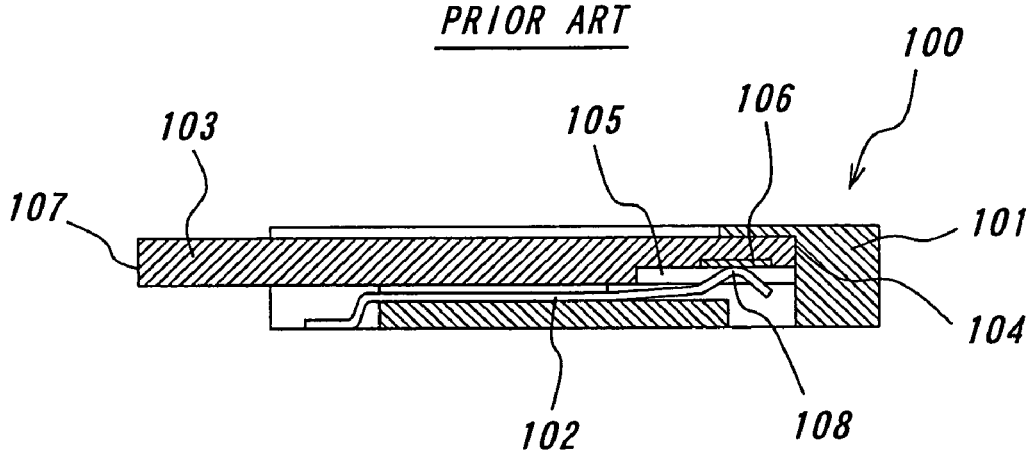
FIG. 8 PRIOR ART
FIG. 8 is a sectional view illustrating the card connector shown in FIGS. 7*a* and 7*b* with a card normally loaded.
Figure 9:
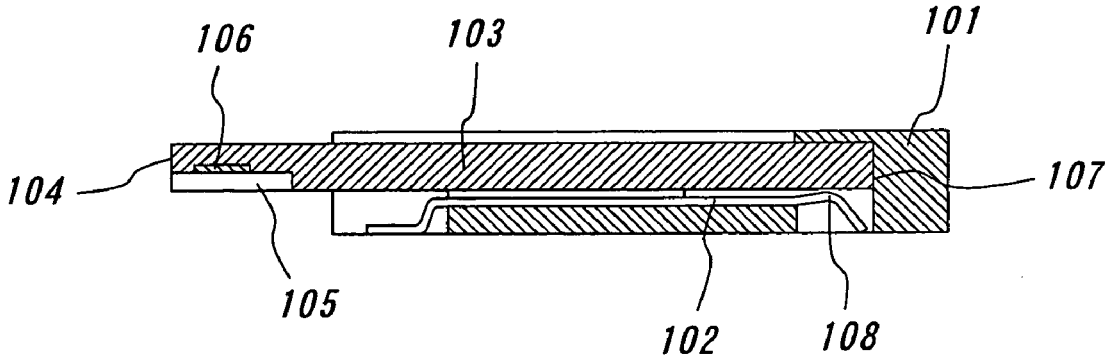
FIG. 9 PRIOR ART
FIG. 9 is a sectional view illustrating the card connector shown in FIG. 7 with a card wrongly inserted with its rear end.
Figure 10A:
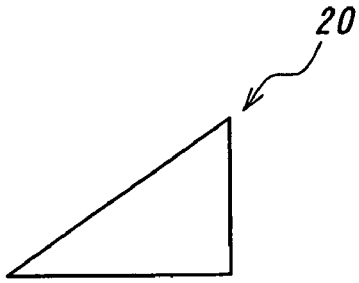
FIGS. 10*a* to 10*d* are sectional views illustrating various embodiments of the support protrusion according to the invention.
Figure 10B:
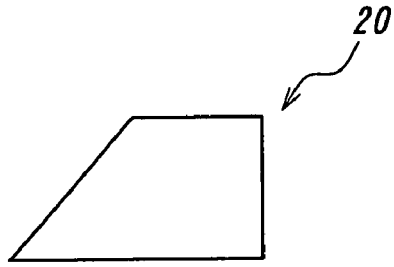
Figure 10C:
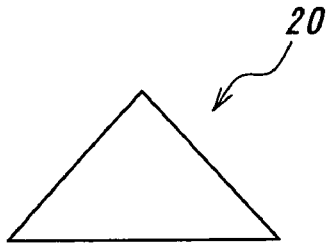
Figure 10D:
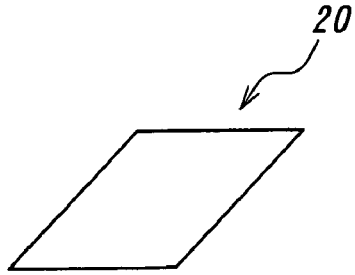

In the case that there is a need for further preventing the plastic deformation of the contact terminals 9 when a card is wrongly inserted with its rear end 4, it is preferable to additionally provide misconnection preventing stoppers 21 located laterally adjacent the support protrusions 20 for preventing such a wrong insertion of a card as shown in FIG. 6. The misconnection preventing stoppers 21 are each received in the recess 5 of a card 2 when it has been normally inserted in the card connector and each have an end face 21*a* adapted to abut against the rear end 4 of the card 2 at a position slightly short of the contact portion 19 of the contact terminal 9 when the card 2 has been wrongly inserted. Moreover, the support protrusions 20 and the misconnection preventing stoppers 21 may be provided integrally with or independently from one another.

Moreover, the contact portion 19 of each the contact terminal 9 preferably has an upwardly projecting curved surface as shown in the drawings for obtaining stable contact force with the contact pad 6 of the card 2.

The support protrusions 20 may be provided so as to contact and support part of the contact portion 19 or to contact and support substantially most of the contact portion 19 of the contact terminal. The support protrusions 20 may be made of any material insofar as they can limit the downward displacement of the contact portion 19 of the contact terminal 9 when the card is normally inserted into the card connector. For example, the support protrusions 20 may be formed of the same material as that of the lower plate 11 of the connector housing 8 or may be a material different from that of the lower plate 11, for example, a metal or plastics and more preferably, but is not limited to, an insulating material.

The support protrusions 20 may have a triangular, trapezoidal, rectangular or other sectional shape. FIGS. 10*a*, 10*b*, 10*c* and 10*d* illustrate the examples of the section of the support protrusions. The support protrusions 20 may be integrally with or separately from the lower plate 11 of the connector housing 8.

INDUSTRIAL APPLICABILITY

According to the invention, a card connector having a proper contact force in an ordinary inserting position of the card between the contact portions of the contact terminals and the contact pads of the cards is realized by providing the support protrusions at a location below at least the contact portion of the contact terminals.

Furthermore according to the present invention, by arranging the height of the support protrusions for limiting an excessive downward displacement of the contact portion of the contact terminals even if the card is inserted by mis-direction, i.e. with its rear end into the card connector, the contact portion of the contact terminal is prevented from being downwardly urged in an excessive extent, thereby preventing the plastic deformation of the contact terminals. As a result, it becomes possible to obtain a more proper contact force stably between the contact portions of the contact terminals and the contact pads of the card.

In addition to the above by providing the misconnection preventing stopper described as above, still further proper and stable connection can be secured.

While the invention has been particularly shown and described with reference to the preferred embodiment thereof, it will be understood by those skilled in the art that the foregoing and other changes in form and details can be made therein without departing from the spirit and scope of the claims.

What is claimed is:

1. A card connector for a card having a plurality of recesses extending in parallel with one another from its front end toward its rear end and contact pads each being received in said recess, said card connector comprising:

a connector housing having a pair of guide grooves for supporting and guiding both side edges of the card being inserted into the card connector and an insertion space for the inserted card;

contact terminals made of a springy and electrically conductive material arranged in said connector housing and each having a contact portion brought into contact with said contact pad of said card normally inserted in the card connector;

support protrusions each provided at a location below at least the contact portion of the contact terminal for limiting the downward displacement of the contact portion of the contact terminal; and misconnection preventing stoppers for preventing a wrong insertion of a card, said stoppers each located laterally adjacent said support protrusion and received in said recess when the card has been normally inserted in the card connector, said stoppers and said support protrusions provided integrally with one another, and said stoppers each having an end face to abut against the rear end of the card at a position slightly short of the contact portion of the contact terminal when the card is wrongly inserted into the card connector.

2. The card connector as set forth in claim 1 wherein said contact portions of said contact terminals each have an upwardly projecting curved surface.

3. The card connector as set forth in claim 1 wherein said support protrusions each have a height for contacting and supporting at least part of the contact portion of the contact terminal when the card has been normally inserted in said card connector.

4. The card connector as set forth in claim 1 wherein said support protrusions each further have a height for limiting the downward displacement of the contact portion of the contact terminal when the card is wrongly inserted with its rear end into the card connector.

* * * * *